US007204557B1

(12) United States Patent
Burton

(10) Patent No.: US 7,204,557 B1
(45) Date of Patent: Apr. 17, 2007

(54) PORTABLE ADJUSTABLE HEADREST FOR SEATS

(76) Inventor: Darryl Burton, 2911 W. 73rd St., Los Angeles, CA (US) 90043

( * ) Notice: Subject to any disclaimer, the term of this patent is extended or adjusted under 35 U.S.C. 154(b) by 0 days.

(21) Appl. No.: 11/478,160

(22) Filed: Jun. 29, 2006

(51) Int. Cl.
*A47C 7/38* (2006.01)

(52) U.S. Cl. ..... 297/397; 297/399

(58) Field of Classification Search ..... 297/397–400, 297/411.1, 411.25
See application file for complete search history.

(56) References Cited

U.S. PATENT DOCUMENTS 1,565,514 A * 12/1925 Schumacher ..... 297/399
2,613,731 A * 10/1952 Roginski ..... 297/399
2,638,152 A * 5/1953 Pulsifer ..... 297/400
2,642,927 A * 6/1953 Rising ..... 297/398
2,650,650 A * 9/1953 Brown ..... 297/411.25
3,253,859 A * 5/1966 Merriman et al. ..... 297/397
3,271,072 A * 9/1966 Barker ..... 297/397
4,788,969 A * 12/1988 Thompson ..... 606/237
5,690,387 A * 11/1997 Sarti ..... 297/397
6,935,695 B2 * 8/2005 Carta Gonzalez et al. .. 297/397

* cited by examiner

*Primary Examiner*—Peter R. Brown
(74) *Attorney, Agent, or Firm*—Goldstein Law Offices, PC

(57) ABSTRACT

A portable adjustable headrest for seats that will prevent a person's head from falling to the side while sleeping including a support bar, telescoping bar, and a headrest pad. The support bar includes a curved flexible top for hanging from a variety of seat-tops, and includes an elongated portion for interaction with the telescoping bar. The telescoping bar is removably attached through bands along the front surface of the support bar allowing for the raising and lowering of the telescoping bar wherein the headrest pad is coupled thereto. The headrest pad is hingeably attached to a ring that is integrally coupled to the telescoping bar, allowing the headrest pad to rotate upwardly and downwardly.

2 Claims, 3 Drawing Sheets

PORTABLE ADJUSTABLE HEADREST FOR SEATS

BACKGROUND OF THE INVENTION

The invention relates to a portable adjustable headrest for seats that will prevent a person's head from falling to the side while sleeping.

The problem with falling asleep in vehicles such as an airplane, a train, or a bus is that once asleep, your head has the tendency of falling sideways from an essentially upright position. Often, the result is contact with the person sitting in the next seat. The person next to you feels awkward; you feel embarrassed and are no longer capable of falling asleep. Thus, unless you are capable of maintaining your head in an upright position while sleeping, the chances of getting some quality sleep while on an air plane are minimal. What is needed is a portable adjustable headrest for a variety of seats that will prevent a person's head from falling sideways while sleeping.

The present invention attempts to solve the abovementioned problem by providing a portable adjustable headrest that will prevent a person's head from falling sideways after falling asleep.

U.S. Pat. No. 5,669,667 to Schmidt discloses a head rest attachment for the seat of a motor vehicle capable of pivoting between an upright position and a folded back position.

U.S. Pat. No. 4,498,704 to Hildreth discloses a headrest capable of being installed on a wheelchair.

U.S. Pat. No. 5,695,251 to Scolari discloses a headrest for a bed with means for adjusting the variation in the level of incline.

While these units may be suitable for the particular purpose employed, or for general use, they would not be as suitable for the purposes of the present invention as disclosed hereafter.

SUMMARY OF THE INVENTION

It is an object of the invention to produce a headrest for seats which prevents a person's head from falling to the side while sleeping in a seated position. Accordingly, the present invention is a portable adjustable headrest including a support bar, telescoping bar, and a headrest pad.

It is another object of the invention to produce a portable headrest for seats that a person can bring with them into any vehicle. Accordingly, the support bar of the portable adjustable headrest includes a curved flexible top that allows for hanging from a seat-top of a variety of seat types.

It is another object of the invention to produce an adjustable headrest for seats that a variety of people can use. Accordingly, the telescoping bar of the portable adjustable headrest includes a spring-loaded peg that allows for a user to select the desired vertical position of the headrest to accommodate a variety of user heights.

It is another object of the invention to produce an adjustable headrest for seats that is selectively engageable. Accordingly, the headrest pad of the adjustable headrest is hingeably attached to a ring coupled to the telescoping bar. Therefore, the headrest pad rotates upwardly and downwardly, allowing a user to engage or disengage the headrest pad as needed.

The invention is a portable adjustable headrest for seats that will prevent a person's head from falling to the side while sleeping including a support bar, telescoping bar, and a headrest pad. The support bar includes a curved flexible top for hanging from a variety of seat-tops, and includes an elongated portion for interaction with the telescoping bar. The telescoping bar is removably attached through bands along the front surface of the support bar allowing for the raising and lowering of the telescoping bar wherein the headrest pad is coupled thereto. The headrest pad is hingeably attached to a ring that is integrally coupled to the telescoping bar, allowing the headrest pad to rotate upwardly and downwardly.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
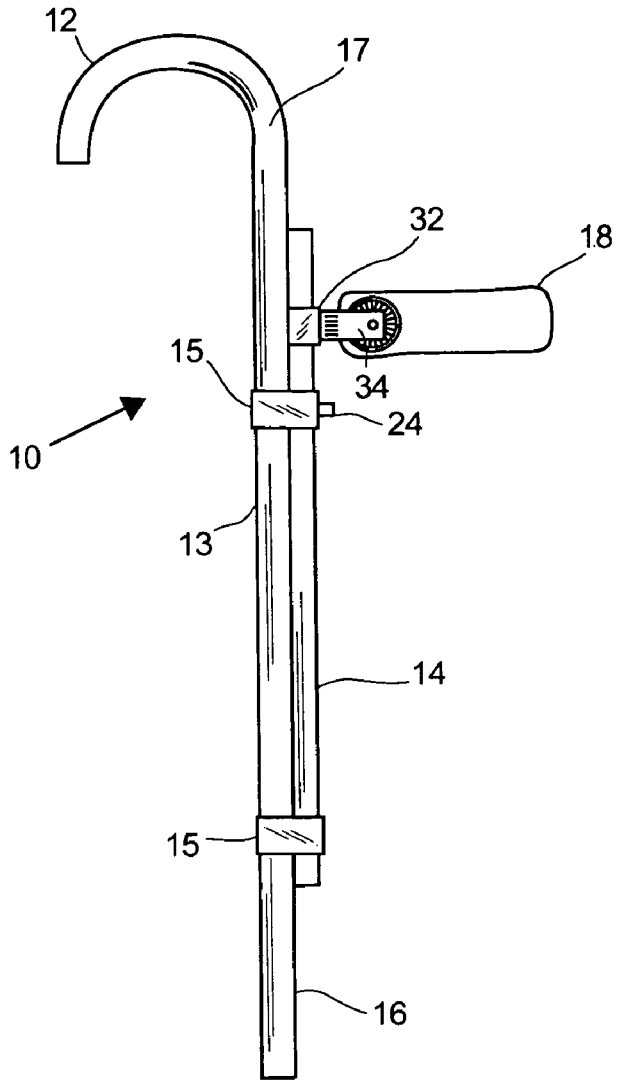
FIG. 1 is a side view of the portable adjustable headrest of the present invention, having a support bar, a telescoping bar, and a headrest pad.

It will be noted in the various figures that the device relates to a portable adjustable headrest 10 for seat-tops 11 that will prevent a person's head from falling to the side while sleeping. In its broadest context, the device consists of a support bar 17, a telescoping bar 14, and a headrest pad 18. Such components are individually configured and correlated with respect to each other so as to attain the desired objective.

FIG. 1 illustrates the portable adjustable headrest 10 for use with seats in vehicles such as airplanes, trains, buses, automobiles. The support bar 17 includes a curved flexible top 12 that allows for hanging from the seat-top 11 of a variety of seat types. The support bar 17 has an elongated portion 13 and a front surface 16. A pair of bands 15 are substantially spaced and affixed to the support bar 17 wherein the telescoping bar 14 extends therethrough. At least one of the two bands 15 includes a spring-loaded peg 24 for selectively holding the telescoping bar 14 in a raised or lowered position.

Figure 3:
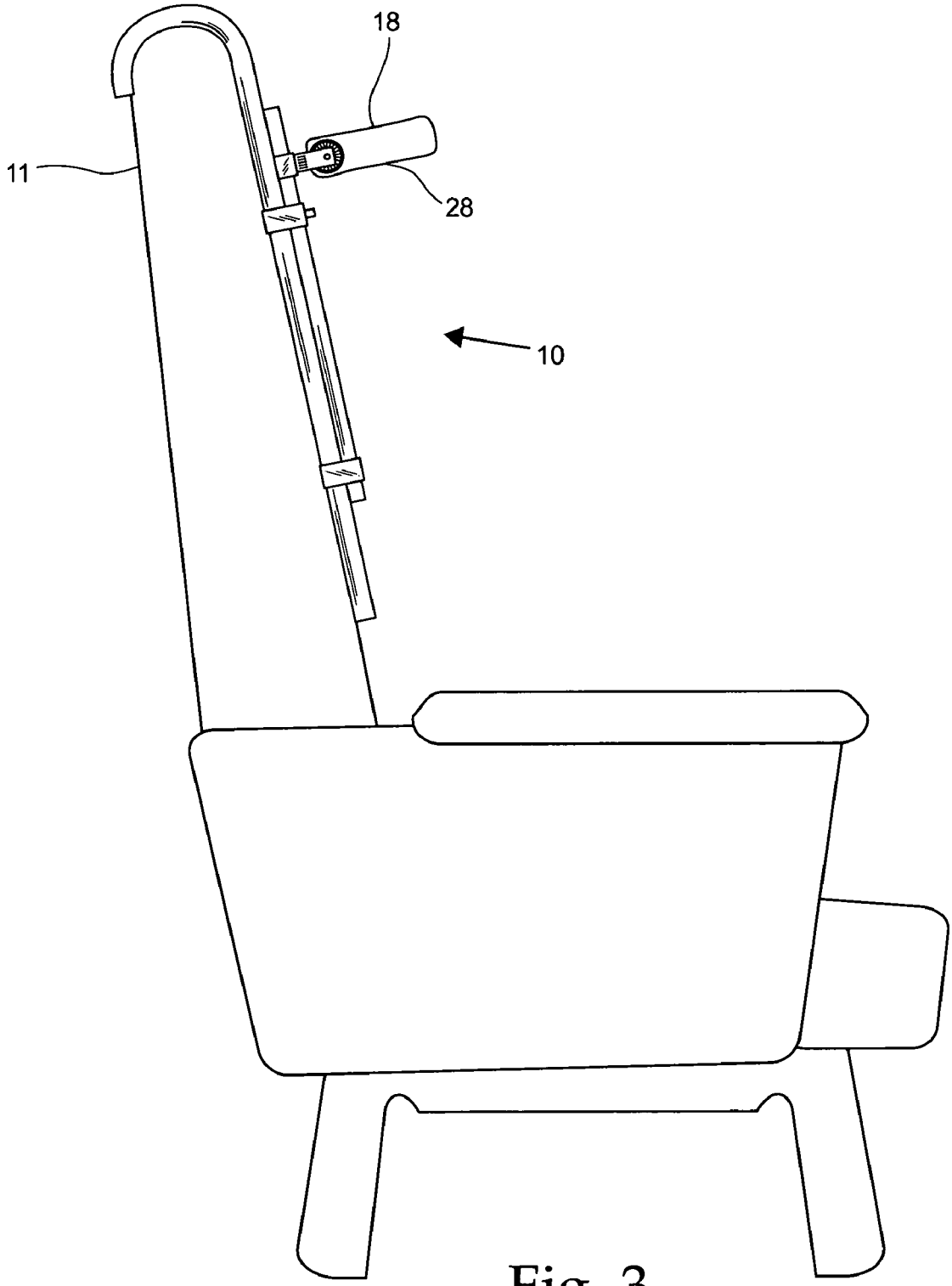
FIG. 3 is a side view of the portable adjustable headrest hanging from a seat top with the headrest pad in an in-use position.
Figure 4:
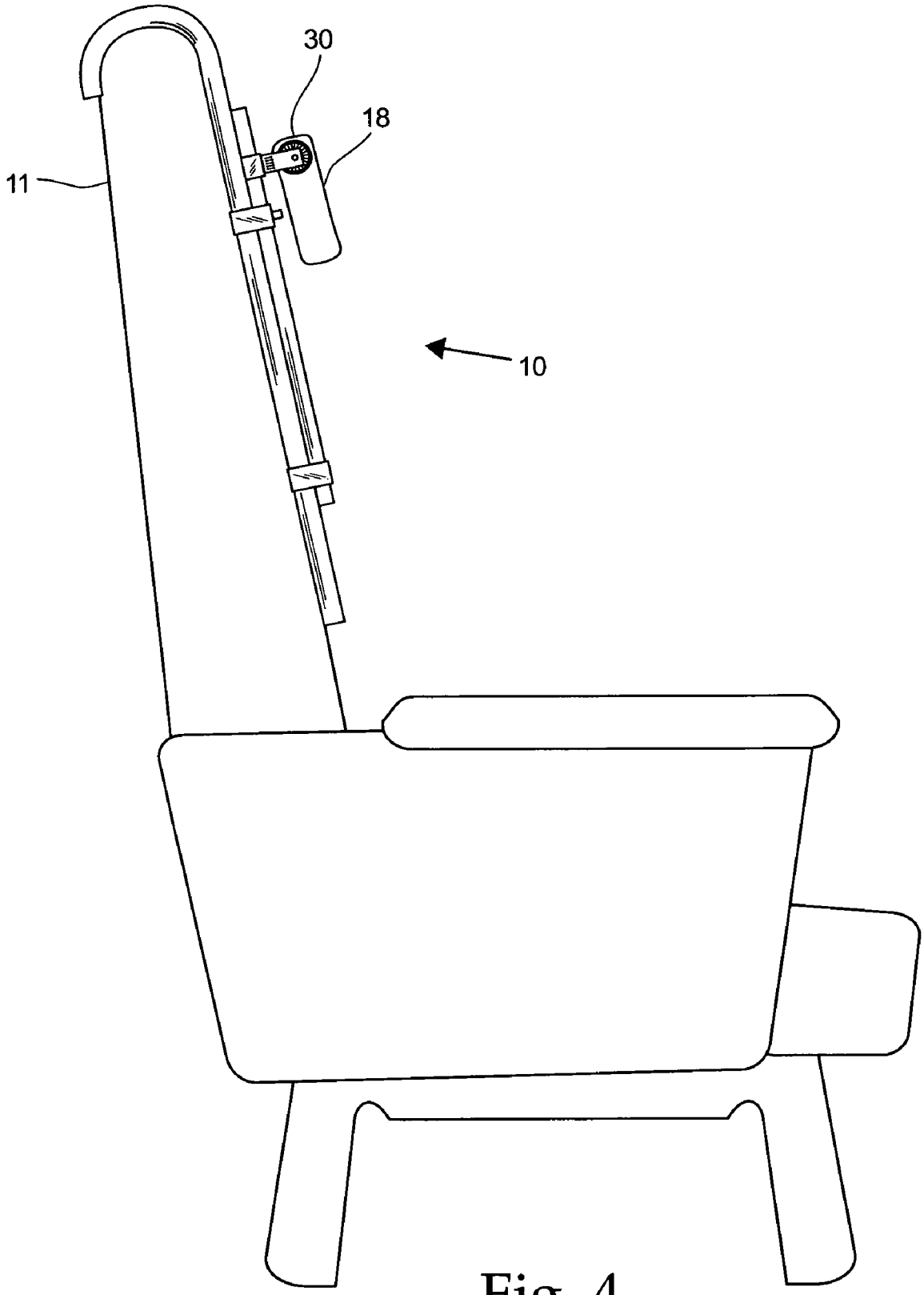
FIG. 4 is a side view of the portable adjustable headrest hanging from a seat top with the headrest pad in an out-of-use position.

The telescoping bar 14 includes the headrest pad 18 attached thereto for allowing a user to move the headrest pad 18 between an in-use and out-of-use position (shown in FIGS. 3 and 4 respectively). The headrest pad 18 is coupled to the telescoping bar 14 by a removable and adjustable ring 32. A hinging mechanism 34 is integrally coupled to the ring 32 and headrest pad 18 which allows the headrest pad 18 to rotate upwardly and downwardly. The telescoping bar 14 is removably attached through the bands 15 along the front surface 16 of the support bar 17 which allows for the raising and lowering of the headrest pad 18.

Thus, a person could bring the portable adjustable headrest 10 with them when they board a vehicle and place it on an existing seat before they fall asleep. When they fall asleep, the headrest pad 18 will prevent the person's head from falling to the side where the portable adjustable headrest 10 is located thereby allowing them a relaxing sleep. A pair of portable adjustable headrests 10 may be used in an alternate embodiment for preventing the person's head from falling to either side.

Figure 2:
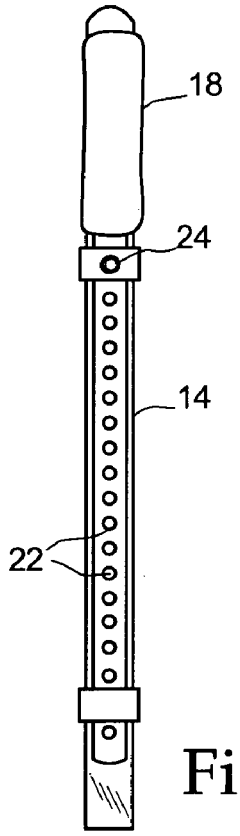
FIG. 2 is a front view of the telescoping bar of the portable adjustable headrest of the present invention, having a plurality of holes for coupling with a spring-loaded peg.

FIG. 2 illustrates the telescoping bar 14 of the present invention. Here, the telescoping bar 14 has a plurality of holes 22 for coupling with the spring-loaded peg 24 allowing a user to select a comfortable height of the headrest pad 18. As shown, the telescoping bar 14 easily slides upwardly and downwardly through the bands 15 to a selected position.

FIG. 3 illustrates the portable adjustable headrest 10 hanging from the top of the vehicle seat top 11. The headrest pad 18 is shown in the in-use position 28, such that (1) the user simply rotates the headrest pad upwardly about the hinging mechanism, and (2) the headrest pad 18 extends outwardly and perpendicularly from the seat top 11 in order to support a person's head.

FIG. 4 illustrates the portable adjustable headrest 10 hanging from the top of a vehicle seat top 11. Here, the headrest pad 18 is rotated downwardly in the out-of-use position 30, parallel to the seat top 11 and out of the way from interference.

What is claimed is:

1. A portable adjustable headrest for seats that will prevent a person's head from falling to the side while sleeping, comprising:

a support bar having a top portion and an elongated portion, the top portion having a curved flexible member for hanging from a seat-top of a variety of seat types, the elongated portion having a front surface with a pair of bands substantially spaced and affixed thereto;

a telescoping bar removably extends through the bands along the front surface of the support bar wherein at least one of the two bands includes a spring-loaded peg for selectively holding the telescoping bar in a raised or lowered position; and a headrest pad coupled to the telescoping bar by a removable and adjustable ring, and having a hinging mechanism integrally coupled to the ring and pad allowing said pad to rotate upwardly and downwardly.

2. A portable adjustable headrest for seats that will prevent a person's head from falling to the side while sleeping, comprising:

a support bar having a top portion and an elongated portion, the top portion having a curved flexible member for hanging from a seat-top of a variety of seat types, the elongated portion having a front surface with a pair of bands substantially spaced and affixed thereto;

a telescoping bar removably extending through said bands, the telescoping bar removably extends through the bands alone the front surface of the support bar wherein at least one of the two bands includes a spring-loaded peg for selectively holding the telescoping bar in a raised or lowered position; and a headrest pad coupled to said telescoping bar, the headrest pad is coupled to the telescoping bar by a removable and adjustable ring, and having a hinging mechanism integrally coupled to the ring and pad allowing said pad to rotate upwardly and downwardly.

* * * * *